United States Patent [19]

Matumoto et al.

[11] 4,396,372

[45] Aug. 2, 1983

[54] BURNER SYSTEM

[75] Inventors: Michiaki Matumoto; Mitsuo Mimura, both of Tokyo; Takeshi Imaizumi, Matsudo, all of Japan

[73] Assignee: Hitachi, Ltd., Tokyo, Japan

[21] Appl. No.: 192,996

[22] Filed: Oct. 2, 1980

[30] Foreign Application Priority Data

Oct. 3, 1979 [JP] Japan ..... 54-126845

[51] Int. Cl.[3] ..... F23D 11/44

[52] U.S. Cl. ..... 431/208; 431/243; 431/351; 431/354; 219/206; 219/273; 261/116; 261/142; 261/DIG. 39

[58] Field of Search ..... 431/207, 208, 243, 349, 431/350, 351, 354, 210; 261/142, 116, DIG. 39; 123/549; 219/206, 207, 273, 275

[56] References Cited

U.S. PATENT DOCUMENTS

| | | | |
|---|---|---|---|
| 1,795,602 | 3/1931 | Hamilton et al. | 261/142 |
| 2,112,973 | 4/1938 | Nicosia | 261/142 |
| 2,235,797 | 3/1941 | Carlson | 417/440 |
| 3,156,292 | 11/1964 | Ross | 431/354 |
| 4,128,390 | 12/1978 | Yoshino et al. | 431/208 |
| 4,175,919 | 11/1979 | Matsumoto et al. | 431/114 |

FOREIGN PATENT DOCUMENTS 54-51030 4/1979 Japan .

*Primary Examiner*—Lee E. Barrett

*Attorney, Agent, or Firm*—Antonelli, Terry & Wands

[57] ABSTRACT

A burner system adapted to vaporize liquid fuel, generally kerosene, and burn gaseous fuel in blue flames includes an evaporator heated by a heater to about 250°-300° C. to vaporize the kerosene. The evaporator is thermally insulated from a premix passage and a burner, to reduce the time required for preheating the evaporator. At the time of ignition, the volume of a portion of primary air supplied to the evaporator is reduced below the corresponding volume supplied in maximum combustion condition and the volume of the kerosene supplied to the evaporator is substantially equal to the corresponding volume supplied in maximum combustion condition. This enables a premix of liquid and air within a combustible limit to be supplied to flame ports even if part of the premixture forms dew in the premix passage, and allows an enriched premixture to flow out of the flame ports at low velocity to facilitate ignition. The evaporator includes an air inlet in the form of a venturi having a throat in which a liquid fuel supply port opens, and an outlet opening in a throat of a venturi mounted in a passage for the rest of the primary air, to supply air at high flow velocity with a low air pressure developed by a blower. The air volume supplied to the evaporator is selected such that the ratio in weight of the air flow rate Ga to the kerosene flow rate Gl or Ga/Gl is between 0.3 and 5.0, to minimize the particle size of atomized kerosene and reduce the capacity of the heater.

4 Claims, 5 Drawing Figures

BURNER SYSTEM

BACKGROUND OF THE INVENTION

1. Field of the Invention

This invention relates to a burner system for burning liquid fuel, or kerosene in particular, by vaporizing same so that combustion of the fuel takes place in blue flames.

2. Description of the Prior Art

In this type of burner system, a kerosene evaporator is provided and heated by an electric heater, and kerosene and primary air of a volume necessary for sustaining primary combustion are supplied to the kerosene evaporator, to vaporize the kerosene simultaneously as the air is heated. The gasified kerosene and heated air are mixed with each other and the mixture is led to flame ports for combustion.

The evaporator generally has a temperature in the range between 250° and 300° C. The gasified kerosene is condensed when the temperature drops and the condensate is deposited on a fuel-air mixture passage. This would cause a reduction in the proportion of the fuel in the mixture below the normal proportion, and satisfactory ignition could not be obtained. One of the factors concerned in the reduction of temperature of the gasified kerosene is the temperature of the fuel-air mixture passage. Another factor is low temperature of the primary air. To avoid the aforesaid trouble, it is customary to supply the primary air to the kerosene evaporator to heat both of them. The primary air is supplied to the evaporator so that it will serve the purpose of changing the kerosene into atomized particles. With regard to the fuel-air mixture passage, the evaporator and the premix passage are maintained in good heat conducting condition, to thereby heat the fuel-air mixture passage. Also, the structural relationship that the evaporator, fuel-air mixture passage and other parts of the burner system are kept in contact with one another is utilized for recovering heat of combustion for use in the evaporator, to minimize or eliminate the need to actuate the electric heater during steady state combustion.

Once combustion has started, the combustion produces heat which raises the temperature in the fuel-air mixture passage to a high level. It is at the time of ignition that the aforesaid trouble of condensation of the gasified kerosene occurs.

Thus, this type of burner system of the prior art has the disadvantage that pre-heating of the evaporator requires a long time at the time of ignition because the primary air and the fuel-air mixture passage should be heated to a predetermined temperature. Another disadvantage is that the burner system consumes a great deal of electric energy because the load applied to the electric heater is high due to the need of keeping the evaporator heated by the electric heater to be ready for the next following combustion cycle even when the burner system is inoperative.

From the foregoing, it will be apparent that when the fuel-air mixture passage and other parts are thermally insulated from the evaporator, it would be possible to conserve electric energy when the burner system is inoperative, but great difficulties would be encountered in igniting a fuel-air mixture.

The following references are cited to show the state of the art:

1. Japanese Patent Application Laid-Open No. 51030/79: Kerosene in constant liquid level container is led to venturi for changing the kerosene to atomized particle form by a blast of air from blower means. The kerosene in atomized particle form is caused to impinge against the gasifying surface of gasifying chamber 14 heated by a heater, and the gasified kerosene forms with air a pre-mixture of fuel and air which flows out of combustion ports to burn.

U.S. Pat. No. 4,175,919 (Japanese Patent Application Laid-Open No. 148839/77): FIGS. 6 and 7 show a burner system constituting the basic form of the embodiment of the present invention. The burner system shown is in straight line form and includes secondary air apertures in the center and slit-shaped flame ports disposed on opposite sides of the secondary air apertures for causing a pre-mixture of fuel and air to flow out therefrom.

SUMMARY OF THE INVENTION

This invention obviates the aforesaid disadvantages of the prior art. Accordingly, an object of the invention is to provide a burner system which enables ignition of a fuel-air mixture to take place satisfactorily while permitting the time required for preheating the evaporator to be minimized at the time of ignition.

Another object is to provide a burner system capable of obtaining good vaporization of fuel by using a blower developing an air blast of relatively low pressure.

The outstanding characteristics of the invention are that primary air supplied to the evaporator is reduced in volume and the rest of the primary air is supplied from outside to the downstream side of the evaporator, and that at the time of ignition the proportion of the air in the fuel-air mixture is reduced while the proportion of the liquid fuel in the mixture is increased as compared with the corresponding proportions in the fuel-air mixture supplied during steady state combustion.

DESCRIPTION OF THE PREFERRED EMBODIMENT

Figure 1:
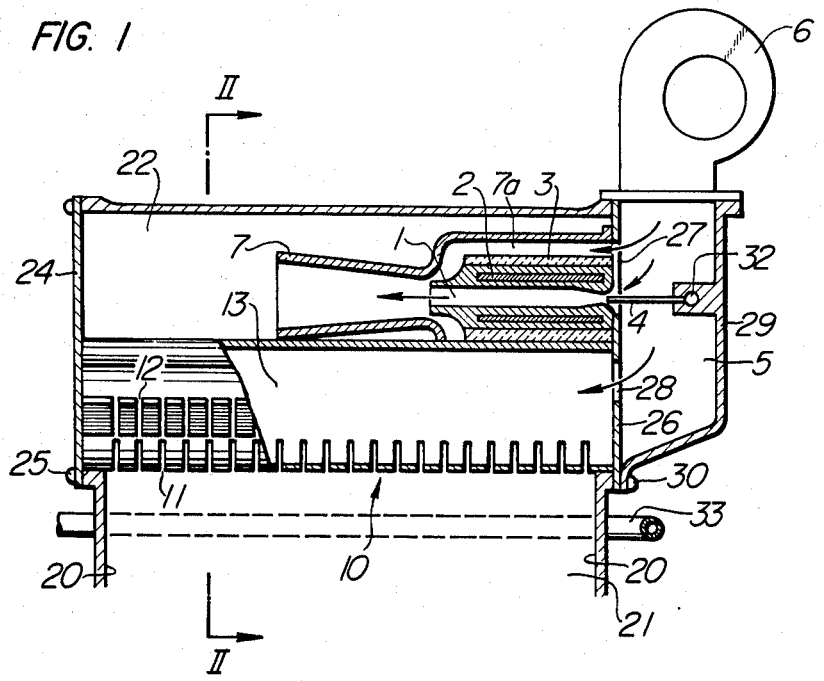
FIG. 1 is a sectional front view of the burner system comprising one embodiment of this invention.
Figure 2:
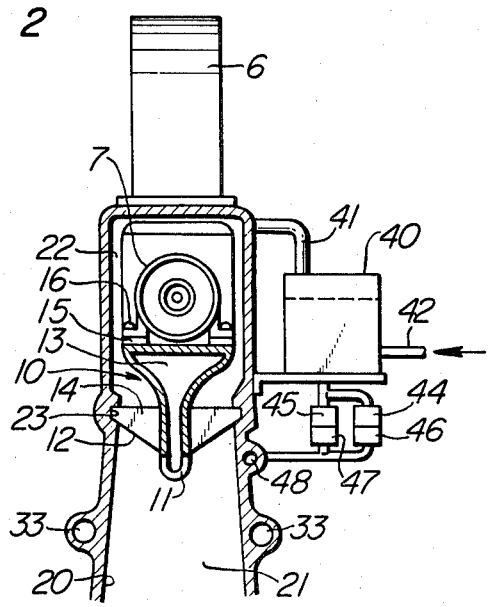
FIG. 2 is a sectional view taken along the line II—II in FIG. 2.

The invention will not be described by referring to one embodiment shown in the accompanying drawings. In this embodiment, kerosene is changed into atomized particle form when supplied to evaporator which is mounted in thermally insulated relation to a premix passage and other parts of the burner system.

The evaporator 1 which is provided with an electric heater 2 is covered at its outer surface with a heat insulating material 3. The evaporator 1 is also provided with a temperature sensor for controlling a current passed to the electric heater 2. The evaporator includes an inlet of a venturi shape and has a kerosene supply pipe 4 opening in a throat of the venturi-shaped inlet which opens in an air distribution chamber 5 communicating with a blower 6. The evaporator 1 also includes an outlet which opens in the middle of a throat of a venturi 7 which in turn is connected at its inlet with the air distribution chamber 5 via a venturi passage 7*a*.

The air supplied to the inlet of the evaporator 1 and the nlet of the venturi 7, which is referred to as primary air, has a volume or a primary air volume which is set at a level higher than a yellow limit of air volume (which is generally considered about 0.7 of the theoretical air volume) with respect to kerosene. The evaporator 1 is designed such that a portion of the primary air that flows into the inlet of the evaporator 1 is very small in volume below the yellow limit.

A burner 10 is formed with secondary air apertures 11 in the center and flame ports 12 on opposite sides of the secondary air apertures 11. The burner 10 is made of aluminum section formed with a secondary air passage 13 in the center and a flame port portion 14 on opposite sides of the secondary air passage 13, in which the secondary air apertures 11 and flame ports 12 are provided in slit form by machining. The secondary air passage 13 opens in the air distribution chamber 5.

The venturi 7 is secured to the burner 10 by screws 16 through a packing 15 of a heat insulating material. The evaporator 1 is also secured to the burner 10 in like manner.

A combustion chamber wall 20 made of aluminum by die casting defines therein a combustion chamber 21 and a premix passage 22, and is formed with grooves 23 in its side portions for receiving end portions of the flame port portion 14 of the burner 10 to hold the latter in place. A space between an outer surface of the venturi 7 and an inner surface of the combustion chamber wall 20 constitute the pre-mixture passage 22 which communicates with the flame ports 12. Thus the combustion chamber wall 20 enclosing the premix passage 22 is a part of theburner 10. The combustion chamber wall 20 is closed at one end by a plate 24 secured to the wall 20 by screws 25. A plate 26 closes the other end of the combustion chamber wall 20 and is formed with openings 27 and 28 for primary air and secondary air respectively. The plate 26 and a box 29 of the air distribution chamber 5 are secured to the combustion chamber wall 20 by screws 30. The box 29 of the air distribution chamber 5 is formed with a kerosene supply passage 32 supporting the pipe 4. 33 designates a water passage.

A constant liquid level container 40 for supplying kerosene is adapted to keep the liquid level substantially at the same height as the opening of the pipe 4. 41 designates an air pipe for applying an air pressure in the air distribution chamber 5 to the liquid surface of the constant liquid level container 40. Kerosene is introduced through an inlet 42 into the container 41, and passed through electromagnetic valves 44 and 45 and orifices 46 and 47 into a kerosene preheating passage 48 of the combustion chamber wall 20, from which the kerosene is led into the kerosene supply pipe 4. The electromagnetic valve 44 is opened at the time of ignition and during combustion, and the electromagnetic valve 45 is opened only at the time of ignition.

The blower 6 is mounted in such a manner that the volume of air supplied thereby undergoes changes depending on the temperature in the water passage 33. Meanwhile the output of the electric heater 2 per unit hour is varied depending on the temperature of kerosene in the kerosene preheating passage 48. Control of the blower 6 and electric heater 2 is effected by separate controllers, not shown.

The volume of air supplied by the blower 6 is controlled such that at the time of ignition the volume is about one half the maximum volume of air supplied during steady state combustion. Even if the volume of air is about one half the electromagnetic valves 44 and 45 are opened to supply kerosene in a volume which is substantially the same as the maximum volume of kerosene supplied during steady state combustion. These changes in the volumes of air and kerosene are controlled by timing means in the aforesaid controllers.

To obtain ignition when various parts of the burner system are still not warmed, a current is first passed to the electric heater 2 to heat the evaporator 1. When the temperature of the evaporator 1 rises to a predetermined level between 250° and 300° C., the blower 6 is actuated. The blower 6 operates in such a manner that the volume of air supplied thereby is about one half the maximum volume of air supplied thereby during steady state combustion. At the same time, the electromagnetic valves 44 and 45 are opened, to supply kerosene. The difference between the pressure applied to the surface of the kerosene in the constant liquid level container 40 and the pressure at the outlet of the kerosene supply pipe 4 is determined by the volume of air supplied by the blower 6, so that the volume of kerosene flow varies in proportion to the volume of air flow. Since the electromagnetic valves 44 and 45 are opened at the time of ignition, the volume of kerosene flow is about the same as the maximum flow rate of kerosene obtained during steady state combustion, even if the volume of air is small. The kerosene is changed into atomized particles by the small portion of primary air introduced into the evaporator 1, and the atomized kerosene is instantaneously gasified in the evaporator 1 to produce a mixture of fuel and air of a temperature slightly higher than the dew point temperature of the kerosene which flows out of the outlet of the evaporator 1.

Meanwhile the portion of primary air led from the air distribution chamber 5 through the venturi passage 7*a* enters the venturi 7 where it is mixed with the fuel-air mixture from the evaporator 1. Being not heated yet, the primary air flowing through the venturi passage 7*a* into the venturi 7 causes the gaseous kerosene of the mixture to condense, so that the mixture of gaseous fuel and air is converted into a fuel-air mixture in the state of a mist of a particle size of below 10$\mu$ which flows into the pre-mixture passage 22, part of the mist being deposited on the wall of the passage and part of same flowing out of the flame ports 12 and ignited by igniting means, not shown, to burn in the combustion chamber 21. Secondary air from the air distribution chamber 5 is ejected through the secondary air apertures 11 into the flames formed in the flame ports 12 in such a manner that the streams of secondary air are supplied to portions of the flames disposed downstream of the flame ports 12. Thus complete combustion of the mixture of fuel and air can be obtained.

Once combustion is started, the combustion chamber wall 20 is heated and the water and kerosene in the passages 33 and 48 respectively are heated. The burner 10 is also heated and the wall thereof constituting the pre-mixture passage 22 has its temperature raised by heating. As a result, the kerosene deposited thereon is vaporized again and flows out. By this time, the electromagnetic valve 45 is closed and the blower 6 supplies air in a volume commensurate with the temperature in the water passage 33. And kerosene is supplied in a volume commensurate with the volume of air.

After lapse of 2–3 minutes following initiation of combustion, the kerosene in the kerosene preheating passage 48 is preheated to about 100°–160° C., so that the amount of heat required for vaporizing the kerosene becomes smaller and a current passed to the electric heater 2 is reduced in amount. The evaporator 1 is kept at a temperature in the range between 250° and 300° C. If the temperature of kerosene exceeds 160° C., the kerosene partially boils, the volume of kerosene undergoes changes or noise is produced. Therefore, the kerosene is preheated to a level below 160° C.

At the time of ignition, the low temperture in the premix passage 22 causes part of the mixture of fuel and air to form dew, as described hereinabove. However, in the venturi 7, the rest of the primary air is supplied in a manner to flow in enclosing relation to the fuel-air mixture flowing out of the evaporator 1. By this arrangement, the fuel-air mixture is prevented from coming into contact with the venturi 7, thereby avoiding deposition of the condensate of fuel. Thus the deposition of the condensate of fuel in the premix passage 22 can be reduced in amount as a whole. The fuel-air mixture flowing out of the flame ports 12 is in the form of a mist of a particle size of below 10$\mu$. However, the results of tests show that it is possible to obtain combustion in blue flames when the particle size is below 10$\mu$, so that no problem is encountered in this respect. Also, dew formation causes a reduction in kerosene volume of the mixture. However, since the air volume is small, the mixture remains in an ignitable range. Particularly, paucity of air slows down the flow velocity of the mixture, so that ignition is facilitated and good ignition can be achieved. The fuel depositing on the pre-mixture passage 22 has a particle size ranging from about 5 to 10$\mu$, so that the deposited fuel can be satisfactorily vaporized when it is heated again.

It is to be understood that care should be exercised in designing the size of the premix passage 22 for reducing the deposition of fuel condensate and the position of the igniting electrodes for facilitating ignition as well as the electric energy used for achieving ignition.

In the embodiment described hereinabove, the kerosene volume used at the time of ignition is equal to the maximum volume used during steady state combustion. This allows a heater for steady state combustion to be used at the time of ignition as well, thereby contributing to simplification of the construction.

As described hereinabove, a small portion of the primary air is supplied to the evaporator 1 along with kerosene. The action of such primary air will now be described.

Figure 3:
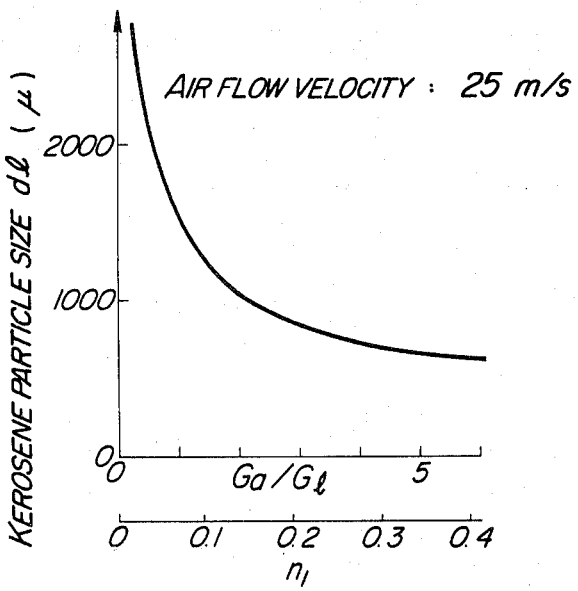
FIG. 3 is a diagrammatic representation of the relation of the ratio by weight Ga/Gl of the volume of air Ga to the volume of kerosene Gl and the particle size of the kerosene in atomized particle form.

FIG. 3 is a diagram showing the results of experiments conducted on the relation between the ratio in weight of the flow rate of the smaller portion of primary air Ga suppied to the evaporator 1 after flowing along the outer periphery of the kerosene supply pipe 4 to the flow rate of kerosene Gl or Ga/Gl and the particle size dl of the kerosene supplied to the evaporator 1. The abscissa also indicates the ratio $\eta_1$ of the smaller portion of primary air to the theoretical air volume. When Ga/Gl=0 or when no air was supplied, the kerosene was not changed into atomized particle form and was supplied in the form of a film which was vaporized while collecting in the lower portion of the evaporator 1. Thus the kerosene remained in high temperature condition for a prolonged period of time and underwent deterioration so that a greater amount of dregs were collected. However, a supply of a small volume of air changed the kerosene to atomized particle form which was blown against the entire surface of the evaporator 1 to be instantaneously vaporized, thereby reduceing the collection of dregs. When the ratio Ga/Gl$\approx$0.3, the kerosene was changed to atomized particle form and good vaporization was obtained. An increase in the ratio Ga/Gl to the range between 2.0 and 5.0 caused a sharp reducing particle size of the kerosene. However, when the ratio Ga/Gl was above the range 2.0–5.0. the rate of reduction in the particle size became lower.

Figure 4:
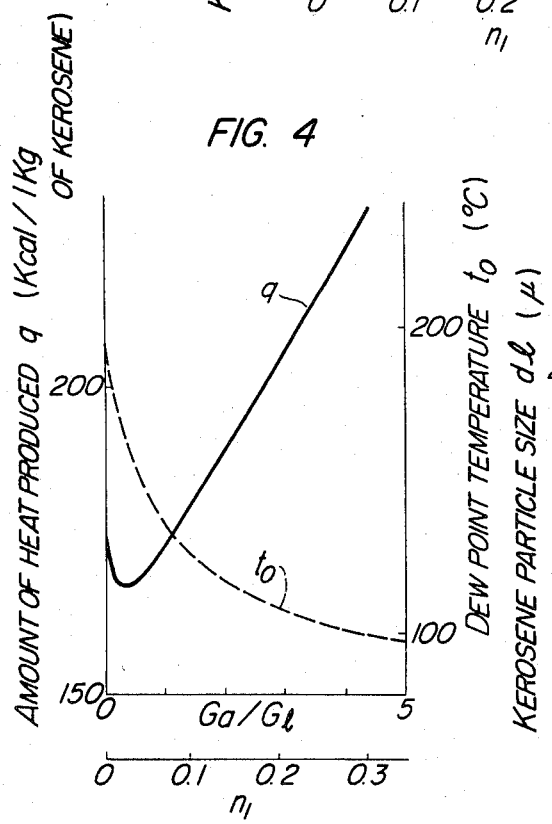
FIG. 4 is a diagrammatic representation of the ratio Ga/Gl in relation to the dew point temperature to of vaporized kerosene and air and the amount of heat of per 1 Kg of kerosene required for heating the gaseous kerosene and air to the temperature $t_o$.

FIG. 4 shows the ratio Ga/Gl in relation to the dew point temperature $t_o$ of the mixture of vaporized kerosene and air and the amount of heat q per 1 Kg of kerosene required for heating the mixture to the dew point temperature $t_o$ or the amount of heat that should be obtained by using the electric heater 2. The abscissa also indicates the ratio $\eta_1$ described by referring to FIG. 3. As can be seen in the figure, a large amount of heat was required when no air was supplied because $t_o$ was high. However, supply of a small volume of air caused a reduction in $t_o$, and the amount of heat q was also reduced and minimized with the ratio Ga/Gl$\approx$0.3. A further increase in the ratio Ga/Gl caused a reduction in $t_o$ and an increase in the amount of heat q because of an increase in the air volume Ga that must be heated.

Thus the minimum value of the air volume supplied to the evaporator 1 is advantageously selected in such a manner that the ratio Ga/Gl$\approx$0.3 which minimizes the amount of heat q, and the maximum value thereof is advantageously selected in such a manner that the ratio Ga/Gl=2.0–5.0 or the ratio is in the range in which the particle size of the kerosene shows a sudden reduction as shown in FIG. 3. Thus, when the particle size of the kerosene supplied to the evaporator 1 and the amount of heat produced by means of the electric heater 2 are both taken into consideration, an optimum value of the ratio in weight of the volume of air Ga supplied to the evaporator 1 to the volume of kerosene Gl supplied to the evaporator 1 or Ga/Gl is in the range between 0.3 and 5.0.

Figure 5:
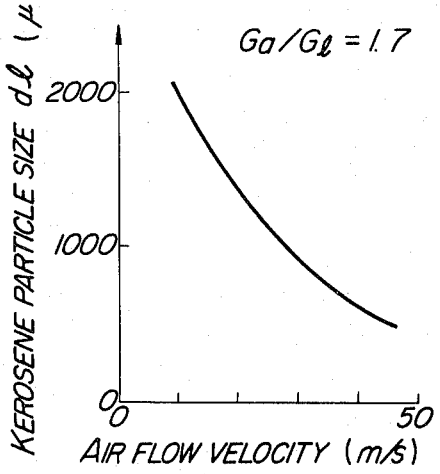
FIG. 5 is a diagrammatic representation of the relation between the velocity of air flowing around the kerosene supply pipe and the particle size of the atomized particles of kerosene.

FIG. 5 shows the results of experiments conducted on the relation between the flow velocity of air along the outer periphery of the kerosene supply pipe 4 and the kerosene particle size dl. In the figure, it will be seen that the higher the Va, the more linearly becomes the reduction in dl. That is, when the flow rate of air along the outer periphery of the kerosene supply pipe 4 is increased, the particle size of the kerosene supplied to the evaporator 1 becomes smaller. This means that vaporization is achieved in less time and the dregs of kerosene can be minimized. The structural feature that the evaporator 1 has a venturi-shaped inlet connected to the kerosene supply pipe 4 enables a high air velocity to be obtained at a small loss of air pressure, thereby reducing the amount of the dregs of kerosene.

Also, the structural feature that the evaporator 1 has its outlet opening in the throat of the venturi 7 at which a subatmospheric pressure is produced permits the portion of the primary air flowing through the venturi passage **7*a* into the venturi 7 to draw the fuel-air mixture flowing through the evaporator 1. Thus the flow rate of the portion of the primary air flowing along the outer periphery of the kerosene supply pipe 4 into the evaporator 1 can be increased with a small air pressure supplied by the blower 6**. This is conductive to reduced production of the dregs of kerosene.

One example of the burner system according to the invention will be described. When Ga/Gl=1.7 and the electromagnetic valves 44 and 45 were opened for about one minute at the time of ignition with an output of about 30,000 kcal/h, good ignition and combustion were obtained.

In the embodiment shown and described hereinabove, the evaporator 1 has been described as being thermally insulated and the kerosene has been described as being changed into atomized particles by means of the primary air. However, it is to be understood that the invention is not limited to the specific form of the embodiment.

What is claimed is:

1. A burner system of the liquid fuel vaporization type comprising:

an evaporator provided with a heater and having an inlet in the form of a venturi, said inlet admitting a first portion of primary air;

a liquid fuel supply port opening in a throat of said venturi-shaped inlet of said evaporator;

an air passage allowing a second portion of the primary air to flow therethrough and supplying same from outside to the downstream side of said evaporator;

a premix passage allowing a premix of said second portion of the primary air with a premixture of fuel with the first portion of the primary air formed is said evaporator to flow to flame ports;

secondary air apertures for supplying secondary air to the downstream side of said flame ports; and a blower for supplying said primary air and said secondary air;

wherein the sum of the volume of the first portion of the primary air supplied to said evaporator and the second portion of the primary air supplied to the downstream side of the evaporator is at a level higher than the yellow limit of air volume with respect to a liquid fuel, and the volume of the first portion of the primary air supplied to the evaporator is lower than the yellow limit.

2. A burner system as claimed in claim 1, wherein said air passage allowing the second portion of the primary air to flow therethrough has a venturi mounted therein and including a throat in which an outlet of said evaporator opens.

3. A burner system as claimed in claim 1, further comprising means for increasing the proportion of the liquid fuel in the mixture of the liquid fuel and primary air supplied to the evaporator at the time of ignition over the proportion of the liquid fuel in the mixture of the liquid fuel and primary air supplied to the evaporator during steady state combustion.

4. A burner system as claimed in claim 3, further comprising means for reducing the volume of the primary air supplied to the evaporator at the time of ignition below the volume of the primary air supplied to the evaporator during steady state combustion.

* * * * *